US005135669A

United States Patent [19]

Brois et al.

[11] Patent Number: 5,135,669

[45] Date of Patent: Aug. 4, 1992

[54] HYDROGENATED LECITHIN FOR FRICTION AND FLOW PROPERTIES

[75] Inventors: Stanley J. Brois, Westfield; Jack Ryer, East Brunswick; Frank Femino, Kearny; Harold E. Deen, Cranford; Antonio Gutierrez, Mercerville, all of N.J.

[73] Assignee: Exxon Chemical Patents, Inc., Linden, N.J.

[21] Appl. No.: 711,572

[22] Filed: May 31, 1991

Related U.S. Application Data

[63] Continuation of Ser. No. 321,371, Mar. 9, 1989, abandoned.

[51] Int. Cl.[5] ..... C10M 137/04

[52] U.S. Cl. ..... 252/32.5; 252/32.7 E; 252/49.6

[58] Field of Search ..... 252/32.5, 32.7 E, 49.6

[56] References Cited

U.S. PATENT DOCUMENTS

| | | | |
|---|---|---|---|
| 2,216,711 | 10/1940 | Musher . | |
| 2,221,162 | 11/1940 | Ashburn et al. . | |
| 2,244,416 | 6/1941 | Ashburn et al. . | |
| 2,257,601 | 9/1941 | Hall et al. . | |
| 2,270,241 | 1/1942 | Adam et al. . | |
| 2,285,854 | 6/1942 | Downing et al. . | |
| 2,295,192 | 9/1942 | Arveson | 252/32.5 |
| 2,302,708 | 11/1942 | Musher . | |
| 2,370,080 | 2/1945 | Schreiber | 252/32.5 |
| 3,284,409 | 11/1966 | Dorer | 252/49.9 |
| 4,622,074 | 11/1986 | Miyoshi et al. | 106/419 |
| 4,919,920 | 4/1990 | Devos | 514/769 |

FOREIGN PATENT DOCUMENTS

| | | |
|---|---|---|
| 0744594 | 4/1933 | France . |
| 1186293 | 4/1970 | United Kingdom . |

*Primary Examiner*—Jacqueline V. Howard
*Attorney, Agent, or Firm*—R. A. Maggio; J. B. Murray, Jr.

[57] ABSTRACT

The present invention provides substantially saturated, e.g., hydrogenated, phospholipid compounds, such as hydrogenated lecithin, which are useful as friction modifying agents for oleaginous compositions such as fuels, and lubricating oils, particularly automatic transmission fluids. The present invention also provides oleaginous compositions containing such phospholipid compounds, and processes for preparing the hydrogenated phospholipids, such as hydrogenated lecithin, and the compositions in which they are contained.

16 Claims, No Drawings

HYDROGENATED LECITHIN FOR FRICTION AND FLOW PROPERTIES

This is a continuation of application Ser. No. 321,371, filed Mar. 9, 1989, now abandoned.

BACKGROUND OF THE INVENTION

The present invention relates to hydrocarbon soluble or dispersible hydrogenated phospholipids and their utility as an additive for oleaginous compositions including, fuel oils, lubricating oils, greases, industrial oils, gear oils, power transmitting fluids, and engine lubricating oils.

There are many instances, as is well known, particularly under boundary lubrication conditions where two moving surfaces in contact with each other must be lubricated, or otherwise protected, so as to prevent wear, and to insure continued movement. There are other instances where friction between two rubbing surfaces is sought to be modified but not necessarily minimized. By controlling friction between two surfaces, the power required to impart movement from one surface to another is also controlled.

For example, a specialized property sought to be imparted to certain lube oil compositions adapted for use as an automatic transmission fluid is the friction modification characteristic of the fluid. This property distinguishes automatic transmission fluids (ATF) from other lubricants, and in fact between types of ATF as well. Accordingly, such friction modification characteristic has received the most attention by both the transmission manufacturers and fluid producers for many years. This attention stems from the fact that the friction requirements of an ATF are unique and depend on the transmission and clutch design, as well as on the type of clutch plate material used.

Another property sought to be imparted to lubricating oil compositions, including automatic transmission fluids, is reduced wear such as bearing and power component wear.

As is also well known, both wear and friction modification can be controlled through the addition of suitable additives with varying degrees of success.

While there are many known additives which may be classified as anti-wear, or friction modifying agents, it is also known that many of these additives act in a different physical or chemical manner and often compete with one another, e.g. they may compete for the surface of the moving metal parts which are subjected to lubrication. Accordingly, extreme care must be exercised in the selection of these additives to insure compatibility and effectiveness.

The metal dihydrocarbyl dithiophosphates are one class of additives which are known to exhibit antioxidant and anti-wear properties. The most commonly used additives of this class are the zinc dialkyl dithiophosphates (ZDDP) which are conventionally used in lubricant compositions. While such zinc compounds afford excellent oxidation resistance and exhibit superior anti-wear properties, they can be corrosive.

Both anti-wear and friction modifying agents function by forming a coating on the surface of the moving metal parts. The coating bonds are generally effected physically and/or chemically. Consequently, if the bonding between the anti-wear agent and the metal part is stronger than the bonding between the friction modifying agent and the metal part, the anti-wear agent will displace the friction modifying agent at metal surface, i.e. at the metal/fluid lubrication boundary interface. This results in a loss in the ability of the friction modifying agent to exert its intended effect.

Various tests have been designed by auto manufacturers for measuring ATF friction and anti-wear properties which if passed, are indicative of the fact that such properties will match the requirements of particular transmission designs and result in transmission durability and smooth shifting under a variety of road conditions.

Friction modification is typically evaluated on an SAE No. 2 friction apparatus. In this test, the motor and flywheel of the friction machine (filled with fluid to be tested) are accelerated to constant speed, the motor is shut off and the flywheel speed is decreased to zero by application of the clutch. The clutch plates are then released, the flywheel is again accelerated to constant speed, and the clutch pack which is immersed in the test fluid is engaged again. This process is repeated many times with each clutch engagement being called a cycle.

During the clutch application, friction torque is recorded as a function of time. The friction data obtained are either the torque traces themselves or friction coefficients calculated from the torque traces. The shape of the torque trace desired is set by the auto manufacturers. One way of expressing this shape mathematically, is to determine the torque: (a) when the flywheel speed is midway between the maximum constant speed selected and zero speed (such torque measurement is referred to herein as $T_D$) and (b) when as the flywheel speed approaches zero rpm (such torque measurement is referred to herein as $T_O$). Such torques can then be used to determine the torque ratio which is expressed as $T_O/T_D$, in which case the typical optimum value thereof is 1, or alternatively, to determine the torque differential $T_O-T_D$; the typical optimum value of which is 0. (Thus, the optimum target value is achieved when $T_O=T_D$ provided $T_D$ is within acceptable limits.) As the $T_O/T_D$ increasingly exceeds 1, a transmission will typically exhibit shorter harsher shifts as it changes gears. On the other hand as $T_O/T_D$ decreases below 1, there is an increasingly greater danger of clutch slippage when the transmission changes gears. Similar considerations apply with respect to $T_O-T_D$ relative to the O target value.

While many automatic transmission fluids can achieve target values of $T_O/T_D$ after a minimum number of cycles, it becomes increasingly more difficult to sustain such target values as the number of cycles is increased. The ability of an ATF to sustain such desired friction properties is referred to herein as friction stability. It is believed that as the ATF ages under the influence of the heat of friction, the anti-wear agent can break down and the decomposition products displace conventional friction modifiers at the metal/fluid lubrication boundary interface. As a result, the fluid may exhibit varying properties.

Attempts to solve the problem of friction instability by simply adding more friction modifier have not met with success because this tends to reduce the breakaway static torque ($T_S$) of the fluid. This parameter when expressed as the breakaway static torque ratio ($T_S/T_D$) reflects the relative tendency of engaged parts, such as clutch packs, bands and drums, to slip under load. If this value is too low, the slippage can impair the driveability and safety of the vehicle.

Thus, transmission designs have undergone radical changes, thereby necessitating the formulation of ATF additives capable of meeting new and more stringent property requirements needed to match such design changes.

No base oil alone can even approach the many special properties required for ATF service. Consequently, it generally is necessary to employ several chemical additives, each of which is designed to impart or improve a specific property of the fluid.

Accordingly, there has been a continuing search for new additives possessed of one or more properties which render them suitable for use in ATF compositions, as well as other oleaginous compositions. The present invention was developed in response to this search.

The prior art contains many examples of improved oleaginous lubricating compositions wherein a phospholipid material such as lecithin is added to an oleaginous material.

For example, U.S. Pat. Nos. 2,216,711 and 2,302,708 disclose processes for improving lubricating oils by adding to the oils an amount of phosphatide material such as lecithin. The phosphatide material is not substantially saturated, e.g., hydrogenated.

U.S. Pat. Nos. 2,221,162 and 2,244,416 also relate to lubricant compositions comprising a phosphatide material, a lubricating oil, and other additives. Again, the phosphatide material is not hydrogenated.

Other patents which disclose the use of a phospholipid such as lecithin in a lubricating oil composition include U.S. Pat. Nos. 2,257,601, 2,270,241, and 2,285,854. In each of these patents, the phospholipid material is not hydrogenated.

SUMMARY OF THE INVENTION

The present invention is based on the discovery that saturated or hydrogenated phospholipids possess excellent friction modification properties. In addition, saturated or hydrogenated phospholipids are stable and hence do not severely, adversely affect friction stability of automatic transmission fluids, nor do they exhibit significant copper corrosion. In short, such hydrogenated phospholipid material is considered a substitute for conventionally employed friction modifiers but with more advantages and fewer disadvantages associated therewith.

The present invention discloses oleaginous compositions comprising an oleaginous material selected from the group consisting of fuel oils and lubricating oils, and at least one substantially saturated, e.g., fully hydrogenated phospholipid. In a preferred embodiment, the lubricating oil is an automatic transmission fluid and the phospholipid compound is hydrogenated lecithin. The hydrogenated lecithin would be present in a preferred composition in an amount from about 0.05 to 2 weight percent, and preferably from about 0.2 to about 0.8 weight percent based on the total weight of the composition.

Disclosed herein is an oil soluble friction modifier useful as an oil additive comprising at least one substantially saturated, e.g., hydrogenated, phospholipid compound, the compound containing at least two substantially saturated fatty acyl chains and a zwitterionic polar head group. Preferably, the fatty acyl chains contain about 16 to 26 carbon atoms and the polar head group is selected from the group consisting of the choline ester of phosphoric acid and the ethanolamine ester of phosphoric acid. Also disclosed is a preferred process for preparing an oleaginous composition useful as a lubricant, which process comprises: hydrogenating a phospholipid compound containing unsaturated fatty acyl chains to obtain a product comprising a phospholipid compound containing substantially saturated acyl chains; and mixing the hydrogenated phospholipid compound with an oleaginous material.

DETAILED DESCRIPTION OF THE INVENTION

It has been discovered that improved oil soluble additives for improved friction modification of oleaginous compositions can be provided from substantially saturated phospholipid materials containing a polar head group comprising a zwitterionic phosphate ester and a nonpolar tail group comprising at least two long chain fatty acyl substituents. The desired phospholipid material is typically derived from, for example, lecithin which is a commercially available mixture of the diglycerides of stearic, palmitic, and oleic acids linked to the choline ester of phosphoric acid. To impart the requisite degree of saturation, the lecithin is hydrogenated. A second example of a suitable initially unsaturated phospholipid starting material which can be hydrogenated for use as an oil soluble additive in accordance with the invention is a compound containing long chain unsaturated fatty acyl groups linked to the quaternized ethanolamine ester of phosphoric acid. Almost any phospholipid material of the requisite degree of saturation can be employed so long as the phospholipid compound contains at least two long chain fatty acyl substituents which are required for oil solubility.

The relatively long fatty acyl chains of the phospholipid compound can have from about 10 to about 50 carbon atoms, preferably about 16 to 26 carbon atoms.

By "substantially free of unsaturation" or "substantially saturated" is meant that the phospholipid compound or mixtures thereof possess a degree of saturation of typically at least 90, preferably at least 95; and most preferably at least about 99 percent of complete carbon-carbon saturation as determined from the proton nuclear magnetic resonance technique at room temperature (21° C.). The reference for complete saturation is a fully hydrogenated derivative of any unsaturated starting material.

It will be understood that the most convenient and cost effective way to obtain the phospholipid products of this invention is to start with naturally occuring unsaturated materials, as described herein, and hydrogenate the same. However, it is not critical to hydrogenate, if a substantially saturated material can be synthesized directly, e.g., using initially saturated fatty acids. From a practical standpoint, however, the most commercially available starting materials are initially unsaturated. Thus, for ease of discussion, the desired phospholipid material is often referred to herein as "hydrogenated" as an alternative way to characterize the material as substantially saturated, and is not intended to imply any absolute requirement for a hydrogenation step.

In general, the phospholipid compounds preferred for use in the present invention belong to the class of compounds having the general formula:

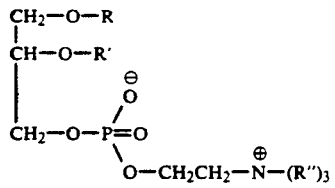

I where R and R' are similar or dissimilar fatty acyl radicals derived from a substituted or unsubstituted fatty acid containing from about 10 to about 50 carbon atoms, preferably from about 10 to about 26 (e.g., 16 to 26) carbon atoms, such as stearic, palmitic, oleic acid and the like, and where each R", independently, represents H or a $C_1$–$C_4$ alkyl group, preferably at least one R" is H and at least one R" is $CH_3$. When R and R' represent substituted fatty acyl radicals the substituent groups may include lauroyl, myristoyl, palmitoyl, stearoyl, behenoyl or combinations thereof.

In the case of lecithin, the phospholipid contains a zwitterionic polar group derived from choline ($—CH_2—CH_2—N(CH_3)_3{}^+OH^-$); and in the case of cephalin, the zwitterionic polar group is derived from colamine ($—CH_2—CH_2—NH_3{}^+OH^-$). Other types of compounds falling within the class of phospholipids or phosphatides can be employed.

Metal derivatives or salts of the phospholipids also can be employed. For example the free acid group of the phospholipid compound can be neutralized with an alkali or alkaline earth metal base, or other base to form the corresponding salt thereof.

Mixtures of two or more phospholipid compounds can also be employed. Mixtures or a single unsaturated phospholipid compound can be hydrogenated in a conventional manner such as by using a palladium (10%) on carbon catalyst in an autoclave at a temperature of about 90° C. and a hydrogen pressure of about 1200–1300 psi.

The resulting hydrogenated phospholipid compound or mixture of compounds, is an excellent oil soluble friction modifier which can be employed as an additive for an oil or fuel composition.

A preferred composition which can be hydrogenated for use in accordance with this invention is commercial soybean lecithin, such as the product known commercially as "Lipoidal" which consists essentially of about equal proportions of lecithin and cephalin with a smaller proportion of soybean oil. In some cases it is found preferable to employ a bleached commercial soybean lecithin, such as the product sold commercially as "Coloidol-BT" which is commercial soybean lecithin bleached with hydrogen peroxide. If desired, the commercial soybean lecithin can be purified by extracting the soybean oil with acetone to obtain a product consisting essentially of lecithin and cephalin, which is also suitable for the purposes of the present invention. Also, the cephalin constituent can be separated from the lecithin by alcohol extraction, and either the purified lecithin or purified cephalin or mixtures of the two in any desired proportion may be employed for purposes of the present invention. However, it has been found that the purified constituents do not display any marked improvement over the bleached commercial soybean lecithin, and the latter is generally preferred for economic reasons.

Wherever the expression "phosphatide compound" or "phospholipid compound" is used throughout the description and claims, it is to be understood that this expression includes any of the purified compounds falling within this group as well as any of the comparatively impure mixtures such as the commercial grades mentioned above.

The hydrogenated phospholipid materials of the present invention have been found to possess very good friction modifying properties as measured herein in a wide variety of environments.

Accordingly, the hydrogenated phospholipid materials are used by incorporation and dissolution into an oleaginous material such as fuels and lubricating oils.

The hydrogenated phospholipid compounds find their primary utility in lubricating oil compositions which employ a base oil in which the additives are dissolved or dispersed. Such base oils may be natural or synthetic, although the natural base oils generally will derive a greater benefit.

Thus, base oils suitable for use in preparing lubricating compositions of the present invention include those conventionally employed as crankcase lubricating oils for spark-ignited and compression-ignited internal combustion engines, such as automobile and truck engines, marine and railroad diesel engines, and the like. Particularly advantageous results are achieved by employing the hydrogenated phospholipid additives of the present invention in base oils conventionally employed in power transmitting fluids such as automatic transmission fluids, tractor fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additives of the present invention.

Thus, the additives of the present invention may be suitably incorporated into synthetic base oils such as alkyl esters of dicarboxylic acids, polyglycols and alcohols; polyalphaolefins, alkyl benzenes, organic esters of phosphoric acids, polysilicone oil, etc.

Natural base oils which will benefit by the addition of the subject saturated phospholipid compounds include mineral lubricating oils which may vary widely as to their crude source, e.g. whether paraffinic, naphthenic, mixed paraffinic-naphthenic, and the like; as well as to their formation, e.g. distillation range, straight run or cracked, hydrofined, solvent extracted and the like. More specifically, the natural lubricating oil based stocks which can be used in the compositions of this invention may be straight mineral lubricating oil or distillates derived from paraffinic, naphthenic, asphaltic, or mixed base crudes, or, if desired, various blended oils may be employed as well as residuals, particularly those from which asphaltic constituents have been removed. The oils may be refined by conventional methods using acid, alkali, and/or clay or other agents such as aluminum chloride, or they may be extracted oils produced, for example, by solvent extraction with solvents such as phenol, sulfur dioxide, furfural, dichlorodiethyl ether, nitrobenzene, crotonaldehyde, etc.

The lubricating oil base stock conveniently has a viscosity of typically about 2.5 to about 12, and preferably about 3.5 to about 9 cst. at 100° C.

Thus the hydrogenated phospholipid additives of the present invention can be employed in a lubricating oil composition which comprises lubricating oil, typically in a major amount, and the hydrogenated phospholipid additive, typically in a minor amount, which is effective to impart enhanced friction modification, relative to the absence of the additive. Additional conventional additives selected to meet the particular requirements of a selected type of lubricating oil composition can be included as desired.

The hydrogenated phospholipid materials of this invention are oil soluble, dissolvable in oil with the aid of a suitable solvent, or are stably dispersible in oil. Oil soluble, dissolvable, or stably dispersible, as that terminology is used herein, does not necessarily indicate that the materials are soluble, dissolvable, miscible, or capable of being suspended in oil in all proportions. It does mean, however, that the hydrogenated phospholipid additives, for instance, are soluble or stably dispersible in oil to an extent sufficient to exert their intended effect in the environment in which the oil is employed. Moreover the additional incorporation of a dispersant and/or other additives may also permit incorporation of higher levels of a particular hydrogenated phospholipid, if desired.

The additives of the present invention can be incorporated into the lubricating oil in any convenient way. Thus, they can be added directly to the oil by dispersing, or dissolving the same in the oil at the desired level of concentration typically with the aid of the suitable solvent such as benzene, xylene, toluene, tetrahydrofuran, ethers such as n-propyl ether, n-amyl ether or the like. Such blending can occur at room temperature or elevated temperatures. Alternatively, the hydrogenated phospholipid additives may be blended with a suitable oil-soluble solvent and base oil to form a concentrate, followed by blending the concentrate with lubricating oil base stock to obtain the final formulation.

The lubricating oil base stock for the additives of the present invention typically is adapted to perform a selected function by the incorporation of additives therein to form lubricating oil compositions (i.e., formulations).

As indicated above, one broad class of lubricating oil compositions suitable for use in conjunction with the hydrogenated phospholipid additives of the present invention include power steering fluids, tractor fluids, tractor universal oils, and the like.

The benefits of the additives of the present invention are particularly significant when employed in a lubricating oil adapted for use as an automatic transmission fluid.

Power transmitting fluids, such as automatic transmission fluids, as well as lubricating oils in general, are typically compounded from a number of additives each useful for improving chemical and/or physical properties of the same. The additives usually are sold as a concentrate package in which mineral oil or some other base oil is present. The mineral lubricating oil in automatic transmission fluids typically is refined hydrocarbon oil or a mixture of refined hydrocarbon oils selected according to the viscosity requirements of the particular fluid, but typically would have a viscosity range of 2.5–9, e.g. 3.5–9 cst. at 100° C. Suitable base oils include a wide variety of light hydrocarbon mineral oils, such as naphthenic base, paraffin base, and mixtures thereof.

Representative additives typically present in such packages as well as in the final formulation include viscosity index (V.I.) improvers, corrosion inhibitors, oxidation inhibitors, friction agents, pour point depressants and seal swellants.

Viscosity modifiers impart high and low temperature operability to the lubricating oil and permit it to remain shear stable at elevated temperatures and also exhibit acceptable viscosity or fluidity at low temperatures.

V.I. improvers are generally high molecular weight hydrocarbon polymers or more preferably polyesters. The V.I. improvers may also be derivatized to include other properties or functions, such as the addition of dispersancy properties.

These oil soluble V.I. polymers will generally have number average molecular weights of from $10^3$ to $10^6$, preferably $10^4$ to $10^6$, e.g. 20,000 to 250,000, as determined by gel permeation chromatography or membrane osmometry.

Examples of suitable hydrocarbon polymers include homopolymers and copolymers of two or more monomers of $C_2$ to $C_{30}$, e.g. $C_2$ to $C_8$ olefins, including both alpha olefins and internal olefins, which may be straight or branched, aliphatic, aromatic alkyl-aromatic, cycloaliphatic, etc. Frequently they will be of ethylene with $C_3$ to $C_{30}$ olefins, particularly preferred being the copolymers of ethylene and propylene. Other polymers can be used such as polyisobutylenes, homopolymers and copolymers of $C_6$ and higher alpha olefins, atactic polypropylene, hydrogenated polymers and copolymers and terpolymers of styrene, e.g. with isoprene and/or butadiene. The polymer may be degraded in molecular weight, for example by mastication, extrusion, oxidation or thermal degradation, and it may be oxidized and contain oxygen. Also included are derivatized polymers such as post-grafted interpolymers of ethylene-propylene with an active monomer such as maleic anhydride which may be further reacted with an alcohol, or amine, e.g. an alkylene polyamine or hydroxy amine, e.g. see U.S. Pat. Nos. 4,089,794; 4,160,739; 4,137,185; or copolymers of ethylene and propylene reacted or grafted with nitrogen compounds such as shown in U.S. Pat. Nos. 4,068,056; 4,068,058; 4,146,489 and 4,149,984.

Suitable hydrocarbon polymers are ethylene copolymers containing from 15 to 90 wt % ethylene, preferably 30 to 80 wt. % of ethylene and 10 to 85 wt. %, preferably 20 to 70 wt. % of one or more $C_3$ to $C_{30}$, preferably $C_3$ to $C_{18}$, more preferably $C_3$ to $C_8$, alpha-olefins. While not essential, such copolymers preferably have a degree of crystallinity of less than 25 wt. %, as determined by X-ray and differential scanning calorimetry. Copolymers of ethylene and propylene are most preferred. Other alpha-olefins suitable in place of propylene to form the copolymer, or to be used in combination with ethylene and propylene, to form a terpolymer, tetrapolymer, etc., include 1-butene, 1-pentene, 1-hexene, 1-heptene, 1-octene, 1-nonene, 1-decene, etc.; also branched chain alpha-olefins, such as 4-methyl-1-pentene, 4-methyl-1-hexene, 5-methylpentene-1, 4,4-dimethyl-1-pentene, and 6-methyl-heptene-1, etc., and mixtures thereof.

Terpolymers, tetrapolymers, etc., of ethylene, said $C_{3-30}$ alpha-olefin, and non-conjugated diolefin or mixtures of such diolefins may also be used. The amount of the non-conjugated diolefin generally ranges from about 0.5 to 20 mole percent, preferably from about 1 to about 7 mole percent, based on the total amount of ethylene and alpha-olefin present.

The preferred V.I. improvers are polyesters, most preferably polyesters of ethylenically unsaturated $C_3$ to $C_8$ mono-and dicarboxylic acids such as methacrylic and acrylic acids, maleic acid, maleic anhydride, fumaric acid, etc.

Examples of unsaturated esters that may be used include those of aliphatic saturated mono alcohols of at least 1 carbon atom and preferably of from 12 to 20 carbon atoms, such as decyl acrylate, lauryl methacrylate, cetyl methacrylate, stearyl methacrylate, and the like and mixtures thereof.

Other esters include the vinyl alcohol esters of $C_2$ to $C_{22}$ fatty or mono carboxylic acids, preferably saturated such as vinyl acetate, vinyl laureate, vinyl palmitate, vinyl stearate, vinyl oleate, and the like and mixtures thereof. Copolymers of vinyl alcohol esters with unsaturated acid esters such as the copolymer of vinyl acetate with dialkyl fumarates, can also be used.

The esters may be copolymerized with still other unsaturated monomers such as olefins, e.g. 0.2 to 5 moles of $C_2$–$C_{20}$ aliphatic or aromatic olefin per mole of unsaturated ester, or per mole of unsaturated acid or anhydride followed by esterification. For example, copolymers of styrene with maleic anhydride esterified with alcohols and amines are known, e.g. see U.S. Pat. No. 3,702,300.

Such ester polymers may be grafted with, or the ester copolymerized with, polymerizable unsaturated nitrogen-containing monomers to impart dispersancy to the V.I. improvers. Examples of suitable unsaturated nitrogen-containing monomers to impart dispersancy include those containing 4 to 20 carbon atoms such as amino substituted olefins as p-(beta-diethylaminoethyl)styrene; basic nitrogen-containing heterocycles carrying a polymerizable ethylenically unsaturated substituent, e.g. the vinyl pyridines and the vinyl alkyl pyridines such as 2-vinyl-5-ethyl pyridine, 2-methyl-5-vinyl pyridine, 2-vinyl-pyridine, 3-vinyl-pyridine, 4-vinyl-pyridine, 3-methyl-5-vinyl-pyridine, 4-methyl-2-vinyl-pyridine, 4-ethyl-2-vinyl-pyridine and 2-butyl-5-vinyl-pyridine and the like.

N-vinyl lactams are also suitable, e.g. N-vinyl pyrrolidones or N-vinyl piperidones.

The vinyl pyrrolidones are preferred and are exemplified by N-vinyl pyrrolidone, N-(1-methyl-vinyl) pyrrolidone, N-vinyl-5-methyl pyrrolidone, N-vinyl-3,3-dimethylpyrrolidone, N-vinyl-5-ethyl pyrrolidone, etc.

Corrosion inhibitors, also known as anti-corrosive agents, reduce the degradation of the non-ferrous metallic parts in contact with the fluid. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of carbon dioxide. Phosphosulfurized hydrocarbons are prepared by reacting a suitable hydrocarbon such as a terpene, or a heavy petroleum fraction of a $C_2$ to $C_6$ olefin polymer such as polyisobutylene, with from 5 to 30 weight percent of a sulfide of phosphorous for ½ to 15 hours, at a temperature in the range of 150° to 600° F. Neutralization of the phosphosulfurized hydrocarbon may be effected in the manner taught, for example, in U.S. Pat. No. 2,969,324.

Oxidation inhibitors reduce the tendency of mineral oils to deteriorate in service which deterioration is evidenced by the products of oxidation such as sludge and varnish-like deposits on the metal surfaces. Such oxidation inhibitors include alkaline earth metal salts of alkylphenolthioesters having preferably $C_5$ to $C_{12}$ alkyl side chains, e.g. calcium nonylphenol sulfide, barium t-octylphenyl sulfide, dioctylphenylamine, phenylalphanaphthylamine, phosphosulfurized or sulfurized hydrocarbons, etc.

Friction modifiers serve to impart the proper friction characteristics to an ATF as determined by the automotive industry.

Representative examples of suitable supplemental friction modifiers which can be employed are found in U.S. Pat. No. 3,933,659 which discloses fatty acid esters, amides; and N-fatty alkyl-N,N-diethanolamines; U.S. Pat. No. 4,176,074 which describes molybdenum complexes of polyisobutenyl succinic anhydride-amino alkanols; U.S. Pat. No 4,105,571 which discloses glycerol esters of dimerized fatty acids; U.S. Pat. No. 3,779,928 which discloses alkane phosphoric acid salts; U.S. Pat. No. 3,778,375 which discloses reaction products of a phosphonate with an oleamide; U.S. Pat. No. 3,852,205 which discloses S-carboxy-alkylene hydrocarbyl succinimide, S-carboxyalkylene hydrocarbyl succinamic acid and mixtures thereof; U.S. Pat. No. 3,879,306 which discloses N-(hydroxy-alkyl)alkenylsuccinamic acids or succinimides; U.S. Pat. No. 4,028,258 which discloses the alkylene oxide adduct of phosphosulfurized N-(hydroxyalkyl) alkenyl succinimides; and U.S. Pat. Nos. 4,344,853, 4,664,826 and 4,600,519 which disclose succinate esters, or metal salts thereof, of hydrocarbyl substituted succinic acids or anhydrides and thiobis alkanols, all for use as friction modifiers in automatic transmission fluids. The disclosures of the above patents are herein incorporated by reference.

Dispersants maintain oil insolubles, resulting from oxidation during use, in suspension in the fluid thus preventing sludge flocculation and precipitation. Suitable dispersants include high molecular weight alkyl succinates, the reaction product of oil-soluble polyisobutylene succinic anhydride with ethylene amines such as tetraethylene pentamine and borated salts thereof.

Pour point depressants lower the temperature at which the fluid will flow or can be poured. Such depressants are well known. Typical of those additives which usefully optimize the low temperature fluidity of the fluid are $C_8$–$C_{18}$ dialkylfumarate vinyl acetate copolymers, polymethacrylates, and wax naphthalene.

Foam control can be provided by an antifoamant of the polysiloxane type, e.g. silicone oil and polydimethyl siloxane.

Anti-wear agents, as their name implies, reduce wear to transmission parts. Representative of conventional anti-wear agents are zinc dialkyldithiophosphate, zinc diaryldithio-phosphate and magnesium sulfonate.

Detergents and metal rust inhibitors include the metal salts of sulfonic acids, alkyl phenols, sulfurized alkyl phenols, alkyl salicylates, naphthenates and other oil soluble mono- and di-carboxylic acids. Highly basic (viz, overbased) metal salts, such as highly basic alkaline earth metal sulfonates (especially Ca and Mg salts) are frequently used as detergents. They are usually produced by heating a mixture comprising an oil-soluble sulfonate or alkaryl sulfonic acid, with an excess of alkaline earth metal compound above that required for complete neutralization of any sulfonic acid present, and thereafter forming a dispersed carbonate complex by reacting the excess metal with carbon dioxide to provide the desired overbasing. The sulfonic acids are typically obtained by the sulfonation of alkyl substituted aromatic hydrocarbons such as those obtained from the fractionation of petroleum by distillation and/or extraction or by the alkylation of aromatic hydrocarbons as for example those obtained by alkylating benzene, toluene, xylene, naphthalene, diphenyl and the halogen derivatives such as chlorobenzene, chlorotoluene and chloronaphthalene. The alkylation may be carried out in the presence of a catalyst with alkylating agents having from about 3 to more than 30 carbon atoms such as for example haloparaffins, olefins that may be obtained by dehydrogenation of paraffins, polyolefins as for example polymers from ethylene, propylene, etc. The alkaryl sulfonates usually contain from about 9 to about 70 or more carbon atoms, preferably from about 16 to about 50 carbon atoms per alkyl substituted aromatic moiety.

The alkaline earth metal compounds which may by used in neutralizing these alkaryl sulfonic acids to provide the sulfonates includes the oxides and hydroxides, alkoxides, carbonates, carboxylates, sulfides, hydrosulfides, nitrates, borates and ethers of magnesium, calcium, and barium. Examples are calcium oxide, calcium hydroxide, magnesium acetate and magnesium borate. As noted, the alkaline earth metal compound is used in excess of that required to complete neutralization of the alkaryl sulfonic acids. Generally, the amount ranges from about 100 to 220%, although it is preferred to use at least 125%, of the stoichiometric amount of metal required for complete neutralization.

Various other preparations of basic alkaline earth metal alkaryl sulfonates are known, such as those described in U.S. Pat. Nos. 3,150,088 and 3,150,089, wherein overbasing is accomplished by hydrolysis of an alkoxide-carbonate complex with the alkaryl sulfonate in a hydrocarbon solvent diluent oil.

Seal swellants include mineral oils of the type that provoke swelling, including aliphatic alcohols of 8 to 13 carbon atoms such as tridecyl alcohol, with a preferred seal swellant being characterized as an oil-soluble, saturated, aliphatic or aromatic hydrocarbon ester of from 10 to 60 carbon atoms and 2 to 4 linkages, e.g. dihexylphthalate, as are described in U.S. Pat. No. 3,974,081.

Some of these numerous additives can provide a multiplicity of effects e.g. a dispersant oxidation inhibitor. This approach is well known and need not be further elaborated herein.

Compositions, when containing these conventional additives are typically blended into the base oil in amounts which are effective to provide their normal attendant function. Representative effective amounts of such additives are illustrated as follows:

| Compositions | Vol % | Wt % |
|---|---|---|
| V.I. Improver | 1-15 | 1-16 |
| Corrosion Inhibitor | 0.01-1 | 0.01-1.5 |
| Oxidation inhibitor | 0.01-1 | .01-1.5 |
| Dispersant | 0.5-10 | 0.5-11 |
| Pour Point Depressant | 0.01-1 | .01-1.5 |
| Demulsifier | 0.001-0.1 | .001-0.15 |
| Anti-Foaming Agents | 0.001-0.1 | .001-0.15 |
| Anti-wear Agents | 0.001-1 | .001-1.5 |
| Seal Swellant | 0.1-5 | 0.1-6 |
| Friction Modifiers | 0.01-1 | .01-1.5 |
| Mineral Oil Base | Balance | Balance |

In a broad sense therefore, the hydrogenated phospholipid additives of the present invention, when employed in a lubricating oil composition, comprise lubricating oil typically in a major amount, and the hydrogenated phospholipid additive, typically in a minor amount which is effective to impart friction modification properties thereto, relative to the same composition in the absence of the additive. Additional conventional additives selected to meet the particular requirements of a selected type of lubricating oil composition can be included as desired.

Accordingly, while any effective amount of the hydrogenated phospholipid additive can be incorporated into the fuel and lubricating oil compositions, it is contemplated that such effective amount be sufficient to provide said composition with an amount of the additive of typically from about 0.01 to about 5.0, preferably from about 0.05 to about 2, and most preferably from about 0.2 to about 0.8%, by weight, based on the weight of said composition.

When other additives are employed, it may be desirable, although not necessary, to prepare additive concentrates comprising concentrated solutions of dispersions of the hydrogenated phospholipid compound together with said other additives (said concentrate additive mixture being referred to herein as an add-pack) whereby the several additives can be added simultaneously to the base oil to form the lubricating oil compositions. Dissolution of the additive concentrate into the lubricating oil may be facilitated by solvents and by mixing accompanied with mild heating, but this is not essential. The concentrate or add-pack will typically be formulated to contain the hydrogenated phospholipid compound and optional additional additives in proper amounts to provide the desired concentration in the final formulation when the add-pack is combined with a predetermined amount of base lubricant. Thus, the hydrogenated phospholipid compound can be added to small amounts of base oil or other compatible solvents along with other desirable additives to form concentrates containing active ingredients in amounts of typically from about 2.5 to about 90%, and preferably from about 5 to about 75%, and most preferably from about 8 to about 50% by weight additives in the appropriate proportions.

The final formulation may employ typically about 10 wt. % of the add-pack with the remainder being base oil.

All of said weight percents expressed herein are based on active ingredient (a.i.) content of the additive, and/or upon the total weight of any additive package, or formulation which will be the sum of the a.i. weight of each additive plus the weight of total oil or diluent.

The following examples are given as specific illustrations of the claimed invention. It should be understood, however, that the invention is not limited to the specific details set forth in the examples. All parts and percentages in the examples as well as in the remainder of the specification and claims are by weight and all temperatures are in degrees Centigrade unless otherwise specified.

EXAMPLE 1

Preparation of Hydrogenated Lecithin

Hydrogenated lecithin was prepared by dispersing 505.6 grams of commercial soybean lecithin (Alcolec, obtained from American Lecithin Company, Inc.) in 1.8 liters of toluene, together with 10 grams of a 10% Pd on carbon catalyst in an autoclave. The reaction mass was gradually heated to a temperature of 90° C. over a period of about 5 hours, during which time hydrogen partial pressure in the system was maintained at about 1200-1300 psi. The reaction temperature was then raised to about 98°-100° C. over a period of about 3½-4 hours, whereafter heating was discontinued. The hydrogen partial pressure was gradually reduced to about 1000 psi by the time that the heating was discontinued. After standing for about 14 hours under a hydrogen partial pressure of between about 750–1000 psi, the reaction mass had cooled down to a temperature of about 30° C. The reaction mass was then siphoned from the autoclave and the autoclave was rinsed with toluene. The reaction mass was filtered and collected in a filter flask. The filtered product (912.3 grams) was a very thick amber colored syrup. A portion (478 grams) of the filtered reaction mass was mixed with 3.4 liters of acetone in a first beaker to precipitate the hydrogenated lecithin and form a smooth suspension. The remaining 434.3 grams of filtered reaction mass was poured into a second beaker together with 3.5 liters of acetone to precipitate hydrogenated lecithin. The flask which contained the filtered reaction mass was rinsed with hot toluene and the rinsings were added to the second beaker. The second beaker contained some lumpy material, therefore the contents of the second beaker was decanted to a third beaker leaving the lumpy material behind. More acetone was added to the second beaker, with heating and stirring, and the second beaker was decanted into a fourth beaker. Still more acetone was added to the remaining lumpy material in the second beaker. The contents of the second beaker was then stirred and boiled until all of the lumpy material was dispersed. By the time all the lumps were dispersed, 14 liters of acetone had been used. The contents of the four beakers were allowed to stand overnight. The hydrogenated lecithin solids contained in the four beakers was combined on an 18 cm Buchner funnel. The combined hydrogenated lecithin solids, which was washed with acetone and air dried, weighed 475.1 grams. The resulting material was fully saturated.

EXAMPLE 2

Formulations were provided as follows for testing friction modification properties.

A Base Fluid was formulated (designated herein as Base Fluid A) containing conventional amounts of a borated ashless dispersant, antioxidant, viscosity index improver, seal swellant, and antiwear agent, dissolved in a paraffinic base oil.

The composition of Base Fluid A is as follows:

| Component | Vol % |
|---|---|
| borated ashless dispersant | 4.4 |
| V.I. Improver | 3.5 |
| antioxidant | 0.28 |
| seal swellant | 0.50 |
| antiwear agent | 0.50 |
| mineral oil base | balance |

To the Base Fluid A was added 0.25 vol. % of lecithin.

The resulting formulation is designated herein as Formulation 1

A second formulation was prepared using Base Fluid A with the exception that 0.1 vol. % of the hydrogenated lecithin prepared in accordance with Example 1 was used in place of lecithin. This formulation is designated herein as Formulation 2.

The Formulations were then tested in accordance with a Ford CJ test and/or a Japanese friction test.

THE FORD C. J. TEST

This test uses a SAE no. 2 type friction machine operated successfully for 200 cycles wherein no unusual clutch plate wear or composition-face plate flaking occurs. The test is conducted on a 700 cc sample at 116°±3° C. in a continuous series of 20 second cycles, each cycle consisting of two phases as follows: Phase I (14 seconds)—motor on at speed of 3,600 rpm, clutch plates disengaged; Phase II (6 seconds)—motor off, clutch plates engaged. Two hundred cycles are repeated using an inertia of 15,300 ft.-lbs. of flywheel torque at 40 psi. of applied clutch pressure. During the clutch engagement, friction torque is recorded as a function of time as the motor speed declines from 3600 rpm to 0. From the torque traces, the dynamic torque ($T_D$) is determined midway between the start and end of clutch engagement (i.e. at a motor speed of 1800 rpm, $T_{1800}$), as well as the torque at 200 rpm ($T_{200}$). The amount of time in seconds in phase II it takes for the motor speed to go from 3600 to 0 rpm is referred to as the lock-up time. The torque ratio of the oil formulation is then determined from ($T_{200}/T_{1800}$).

The conditions for the Ford CJ friction test are as follows shown in Table 1.

TABLE 1

| Ford CJ Friction Test<br>Test Conditions |
|---|
| Inertia: 15,300: ft.-lb. KE |
| Cycle Time: 20 seconds, motor on 14 seconds, off 6 seconds |
| Air Apply Pressure: 40.0 PSI (276 KPA) |
| Fluid Temperature: 240 ± 5° F. (116 ± 3° C.) |
| Velocity: 3600 RPM |
| Fluid Charge: 700 cc |
| Test Time: 200 cycles |
| Fluid: Formulation 2 |
| Plates FMX: Reverse, Waffle Groove, SD 1240 Friction Material |

The Ford CJ Test data is set forth in Table 2, the data being derived from the 200th cycle.

TABLE 2

| | Ford CJ Test | | |
|---|---|---|---|
| Formulation No. | $T_{200}$ (nM) | $T_{1800}$ (nM) | $T_{200}/T_{1800}$ |
| 2 (hydrogenated lecithin) | 126 | 136 | 0.93 |

The data is Table 2 shows that an automatic transmission formulation which contains hydrogenated lecithin as a friction modifier possesses a torque ratio in the acceptable range.

THE JAPANESE FRICTION TEST

The Japanese friction test was used to illustrate the effects of a given additive on friction and modification. This test is similar to the Ford CJ test, but was run for 200 cycles using 15,300 ft. lbs. of flywheel torque at 32 psi clutch pressure. Each cycle took 30 seconds and consisted of the following phases: Phase I (10 seconds)—motor on at speed of 3600 rpm, clutch disengaged; Phase II (5 seconds)—motor off, clutch engaged; and Phase III (15 seconds)—motor off, clutch disengaged. The test, which was run using an 800 cc test sample at a temperature of 100°±3° C., was run using Formulation I (contains lecithin), Formulation 2 (contains hydrogenated lecithin as the friction modifier in place of lecithin) and test formulations which use a hydroxyalkyl amine friction modifier in place of hydrogenated lecithin. These latter test formulations designated as Formulation 3, 4 and 5 contained 0.10, 0.15 and 0.20 vol. %, respectively, of a commercial hydroxyalkyl amine product as the friction modifier. The hydroxyalkyl amine friction modifier is available under the trade name designation Ethomeen 18-12 from the Armak Chemical Division of Akzo Chemie.

During the clutch engagement, friction torque is recorded as a function of time as the motor speed declines from 3600 rpm to 0. The dynamic coefficient of friction ($\mu_D$) is determined midway between the start and end of clutch engagement (i.e. at a motor speed of 1800 rpm), as well as the coefficient of friction at 200 rpm ($\mu_D$). The amount of time in seconds in phase II it takes for the motor speed to go from 3600 to 0 rpm is referred to as the lock-up time. The ratio of the oil formulation is then determined from $\mu_O/\mu_D$. Normally, a value for $\mu_O/\mu_D$ of 1 or less is required for satisfactory operation.

In addition to determining midpoint dynamic coefficient of friction ($\mu_D$) and coefficient of friction at 200 rpm ($\mu_O$), the breakaway static coefficient of friction ($\mu_S$) is also determined. This is achieved by rotating the composition plates at 2 to 3 rpm under a load of 40 psi. while locking the steel reaction plates and preventing them from rotating. The breakaway static coefficient of friction is then measured until slippage occurs and the maximum coefficient of static friction observed is recorded as $\mu_S$. The higher the value of $\mu_S$, the less chance there is of clutch slippage at low speeds. Accordingly, the most desirable automatic transmission formulations would exhibit both a value of $\mu_O/\mu_D$ of 1 or less and a high value for $\mu_S$. From $\mu_S$ is determined the Breakaway Static ratio ($\mu_S/\mu_D$).

The breakaway static ratio also expresses the ability of the transmission to resist slippage; the lower the ratio, the higher the slippage. However, this ratio is normally evaluated in conjunction with $\mu_O/\mu_D$.

The conditions for the Japanese friction test are summarized in Table 3 as follows:

TABLE 3

| Japanese Friction Tests | |
|---|---|
| Test Conditions | |
| Total Test Cycle | 200 |
| Sample Oil Volume (cc) | 800 |
| Total Cycle Time (Sec.) | 30 |
| Test Oil Temperature (°C.) | 100 |
| Moment of Inertia (Kg Cm Sec$^2$) | 3.1 |
| RPM of Main Motor | 3600 |
| Plate/Disc Arrangement | S-F-S-F-S-F-S |
| Clutch Plate Friction Material | SD 1777X |

The results of the Japanese friction test are set forth in Table 4, the results being derived from the 200th cycle.

TABLE 4

| Japanese Friction Test | | | | | |
|---|---|---|---|---|---|
| Formulation No. | $\mu_O$ | $\mu_D$ | $\mu_S$ | $\mu_O/\mu_D$ | $\mu_S/\mu_D$ |
| 1. (0.25 vol. % lecithin) | 0.12 | 0.11 | 0.159 | 1.10 | 1.45 |
| 2. (0.10 vol. % hydrogenated lecithin) | 0.133 | 0.134 | 0.160 | 0.99 | 1.19 |
| 3. (0.10 vol. % hydroxyalkyl amine) | 0.145 | 0.136 | 0.143 | 1.07 | 1.05 |
| 4. (0.15 vol. % hydroxyalkyl amine) | 0.135 | 0.136 | 0.129 | 0.99 | 0.95 |
| 5. (0.20 vol. % hydroxyalkyl amine) | 0.131 | 0.135 | 0.113 | 0.98 | 0.84 |

Referring to Table 4, it can be seen that the ratio of $\mu_S/\mu_D$ for Formulation 2 (which contains hydrogenated lecithin) is entirely acceptable, as is the ratio $\mu_O/\mu_D$ for the Formulations 4 and 5 (which contain 0.15 and 0.2 vol. % of the commercial hydroxyalkyl amine friction modifier).

However, the data clearly show that the ratio of $\mu_O/\mu_D$ for Formulation 1 (which contains lecithin) and for Formulation 3 (which contains 0.1 vol. % of the same hydroxyalkyl amine friction modifier as Formulation 4 and 5) are higher than acceptable. The data also shows that the breakaway static coefficient of friction ($\mu_S$) for Formulation 2 is desirably high, and, in fact, is higher than any of the formulations tested, including those which contain the hydroxyalkyl amine friction modifier. Moreover, this is achieved at acceptable $\mu_O/\mu_D$ valves. In contrast, while $\mu_S$ for Formulation 1 is similar to Formulation 2, the $\mu_O/\mu_D$ is unacceptable. Similarly, while $\mu_S/\mu_D$ for Formulation 1 is highest, this is achieved at the expense of an unacceptable $\mu_O/\mu_D$. Thus, the balance of $\mu_O/\mu_D$, $\mu_S$, and $\mu_S/\mu_D$ achieved for Formulation 2 is the most desired for the illustrated runs. In addition, the data also show that the breakaway static ratio ($\mu_S/\mu_D$) for Formulation 2 (contains hydrogenated lecithin) is higher, and thus superior than the ratio for any of Formulations 3, 4 or 5.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. An automatic transmission fluid composition comprising:

(A) lubricating oil;

(B) dispersant;

(C) anti oxidant;

(D) seal swell agent;

(E) anti-wear agent;

(F) V.I. improver; and (G) a friction modifying amount of at least one substantially saturated phospholipid compound.

2. A composition according to claim 1, wherein said phospholipid friction modifying compound is present in an amount from about 0.1 to about 5 weight percent based on the weight of the composition.

3. A composition according to claim 1, wherein said phospholipid compound is represented by the formula:

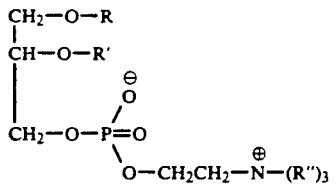

where R and R′ are the same or different fatty acyl radicals derived from a substituted or unsubstituted fatty acid containing from about 10 to about 50 carbon atoms, and where each R″, independently, is H or a $C_1$–$C_4$ alkyl group.

4. A composition according to claim 3, wherein at least one R″ is H and at least one R″ is $CH_3$.

5. A composition according to claim 3, wherein said phospholipid compound is hydrogenated lecithin or a metal derivative or salt thereof.

6. A composition according to claim 3, wherein said phospholipid compound is hydrogenated cephalin or a metal derivative or salt thereof.

7. A composition according to claim 1, wherein said phospholipid compound contains at least two saturated fatty acyl chains and a zwitterionic polar head group.

8. A composition according to claim 7, wherein in said phospholipid compound said fatty acyl chains contain about 16 to 26 carbon atoms.

9. A composition according to claim 7, wherein said zwitterionic polar head group is selected from the group consisting of the choline ester of phosphoric acid and the ethanolamine ester of phosphoric acid.

10. A composition according to claim 3 wherein R and R′ contain from about 16 to about 26 carbon atoms, and where each R″, independently is H or a $C_1$–$C_4$ alkyl.

11. A composition according to claim 1, wherein said phospholipid contains a zwitterionic polar group derived from an aminoalcohol.

12. A composition according to claim 1 wherein the dispersant is a borated ashless dispersant.

13. The composition according to claim 12 wherein the anti-wear agent is zinc dihydrocarbyl dithiophosphate.

14. A concentrate adapted for use as the lubricating oil composition of any one of claims 1, 2–6, and 11 upon dilution.

15. A method for modifying the friction characteristics of an automatic transmission fluid which comprises employing at least one substantially saturated phospholipid compound as a friction modifier in said fluid.

16. The method of claim 15 wherein the phospholipid friction modifier is employed according to the phospholipid of any one of claims 1, 2–6, 7–10, and 11.

* * * * *